United States Patent [19]

Owen

[11] 4,170,845

[45] Oct. 16, 1979

[54] HYDRAULIC RAILROAD CAR DOOR WITH PROGRAM PLATE

[76] Inventor: Robert E. Owen, P.O. Box 1288, Sioux City, Iowa 51102

[21] Appl. No.: 714,801

[22] Filed: Aug. 16, 1976

[51] Int. Cl.[2] ..... E05D 15/10

[52] U.S. Cl. ..... 49/220; 49/360; 49/280; 49/449

[58] Field of Search ..... 49/220, 280, 281, 449, 49/360

[56] References Cited

U.S. PATENT DOCUMENTS

| | | | |
|---|---|---|---|
| 3,397,489 | 8/1968 | Cook | 49/281 |
| 3,488,074 | 1/1970 | Herr | 49/220 X |
| 3,885,349 | 5/1975 | Owen | 49/220 |

*Primary Examiner*—Kenneth Downey

*Attorney, Agent, or Firm*—Hiram A. Sturges

[57] ABSTRACT

A hydraulic railroad car door assembly comprising a sliding door of the plug type carried on crank arms rotated by shafts rotating with respect to the door, the door opening and closing by the swinging of the crank arms which are carried by tracks on which the door slides, a program plate slidably mounted on the door and having slots therein, door latching assemblies, and means including pins received in the slots for causing sequenced unlatching and door opening and sequenced door closing and latching as said program plate is reciprocated by a cylinder controlled by a hydraulic pump.

18 Claims, 9 Drawing Figures

HYDRAULIC RAILROAD CAR DOOR WITH PROGRAM PLATE

FIELD OF THE INVENTION

This invention is in the field of hydraulically operated railroad car doors of the type the opening, closing, and latching and unlatching of which is powered by a hydraulic pump operating through a hydraulic cylinder.

DESCRIPTION OF THE PRIOR ART

A patent was issued Feb. 6, 1973 U.S. Pat. No. 3,714,735 was issued to the applicant, Robert E. Owen, titled: HYDRAULICALLY OPERATED RAILROAD CAR DOOR. In this patent separate cylinders were used at each of four door latches, two for each side of the door, and separate cylinders were used at each of four individual rotating shafts controlling crank arms for opening and closing the door. This patent made possible the elimination of many inventory problems involving quantities of mechanical parts used for mechanical grain doors of the prior art. This patent also provided the advantage of a hydraulic cushioning effect to prevent a tearing off of tracks fixed to the box car because of the jolt involved when a sliding door of the prior art suddenly stopped; the hydraulic cushioning also cutting down wear on other parts of a door jolted by sudden stopping.

Another hydraulic door U.S. Pat. No. 3,885,349 was issued May 27, 1975 to the applicant, Robert E. Owen, titled: HYDRAULICALLY CONTROLLED DOOR WITH TANDEM CRANK ARMS AND LATCHES. This second patent preserved the latching sequencing and hydraulic cushioning advantages but eliminated much of the problem of synchronization in the operation of the various crank arms and latches which was a characteristic of the door of U.S. Pat. No. 3,714,735.

However, it still used four separate cylinders, one for each of two crank arm shafts and one for each pair of latches, of which latter there were one pair of the left side of the door and one pair on the right. Synchronization of the latches was difficult because, for example, if one of the left latches would stick, then all motion of the left cylinder would be applied only to the other one of the left latches. Also if one crank arm met with greater resistance in the process of its turning, then the hydraulic fluid would operate, out of synchronization, the pair of crank arms on the other crank arm shaft.

It is desirable that perfect synchronization of both latches and crank arms be achieved and yet that the advantages of hydraulic cushioning be preserved and other advantages made available, chief among the other advantages to be made available is hydraulic sealing of the door.

Doors having only latches do not seal well, the latches being chiefly useful only for safety.

In the prior art, pumps of the type which pump during motions of the piston in each of two opposite directions have been of kinds having outside valves and having conduits associated with the check valves on the outside of the cylinder, where they are easily damaged. They also have been complex, requiring an excessive number of valves.

SUMMARY OF THE INVENTION

An object of this invention is to provide a laterally movable sliding door for a railroad car for operation in upper and lower guiding and supporting door tracks, and having two upper and two lower horizontally extending crank arms, representing a left pair of crank arms and a right pair of crank arms, the left crank arms being disposed on and controlled by a left crank arm shaft, the right crank arms being disposed on and controlled by a right crank arm shaft, track following means on the upper crank arms, and track following and door supporting means mounted on the lower crank arms, horizontally moving right and left latches moving inwardly for opening and outwardly for closing, a program plate slidably mounted on the door for vertical movements both upwardly and downwardly, slots in the program plate, means including pins disposed in and moved by the walls of said slots as said program plate is moved upwardly and downwardly and connected to said shafts and to said latches for causing said latches to first open and then said shafts to rotate for opening said door thereafter (when said program plate is moved in one direction) said slots having walls shaped for causing said pins to be moved in another manner as said program plate is moved in an opposite direction for causing first said door to close, and said latches to latch, a hydraulic cylinder connected to and moving said program plate in each of said directions, a hydraulic system having a controllable valve for determining the direction of motion, whether extension or retraction, of said cylinder, and further having a hydraulic power supply system comprising a pump connected to said valve and cylinder for powering said cylinder.

A second object of this invention is to provide a door as described in which said hydraulic system has a relief valve for causing excess pressure in its hydraulic lines to result in the harmless delivery of hydraulic fluid back to a reservoir so as to cushion the effect of a sudden stoppage of motion of the door while it is sliding.

A further object is to provide a special pump for said hydraulic system, which latter has a piston designed to deliver hydraulic fluid during motion of its piston in each of two opposite directions, so that, during piston motion of said pump, hydraulic fluid is constantly delivered into the remainder of the hydraulic system so as to be available to drive said cylinder.

A still further object of the invention is to provide a hand lever for operating the pump, the hand lever being provided with a terminal end disposed farthest from the pump and track means mounted on the door and slidably connected to the terminal end of said lever for giving said lever a slidable anchoring so that a vandal or an inexperienced person cannot pull the lever outwardly directly away from the door in a manner for breaking the lever or bending it, and yet for preserving the freedom of pumping motion in each of two directions.

Another objective is to provide the concept of a program plate mounted on a door and operating generally as described, with the motion of the program plate in any direction, but with the walls of the slots so shaped and disposed as to result in the sequences of latching, unlatching and door opening and door closing as described.

A particular objective is to provide a door-holding valve which is a pilot-operated check valve arranged in a hydraulic circuit in such a way that the door is held closed automatically, once pumping for door closing and latching has stopped. This automatic holding is not to stop a thief because the door can be padlocked shut to take care of that. However, it is for the important purpose of holding the door sealed and airtight just as it is at the end of a closing and latching pumping operation. The importance of the hydraulic holding for maintaining this sealing can be understood because the latches themselves are only safety latches and all real sealing pressure comes from the hydraulic system of this invention and is maintained by the normally closed pilot-operated check valve.

A further object of the invention is to provide the concept of a pump of the kind capable of pumping while the piston moves in each of two opposite directions, and further having two check valves in the piston itself and having passages through larger and smaller sections of the piston which are closed at proper times by the check valves, the resulting pump being simpler, more economical, having fewer valves, and eliminating those exterior valving conduits associated with the exterior check valves in pumps for such purposes in the prior art.

A further object is to provide a two-way pump as described which is more maintenance free.

DESCRIPTION OF THE PREFERRED EMBODIMENT

Figure 1:
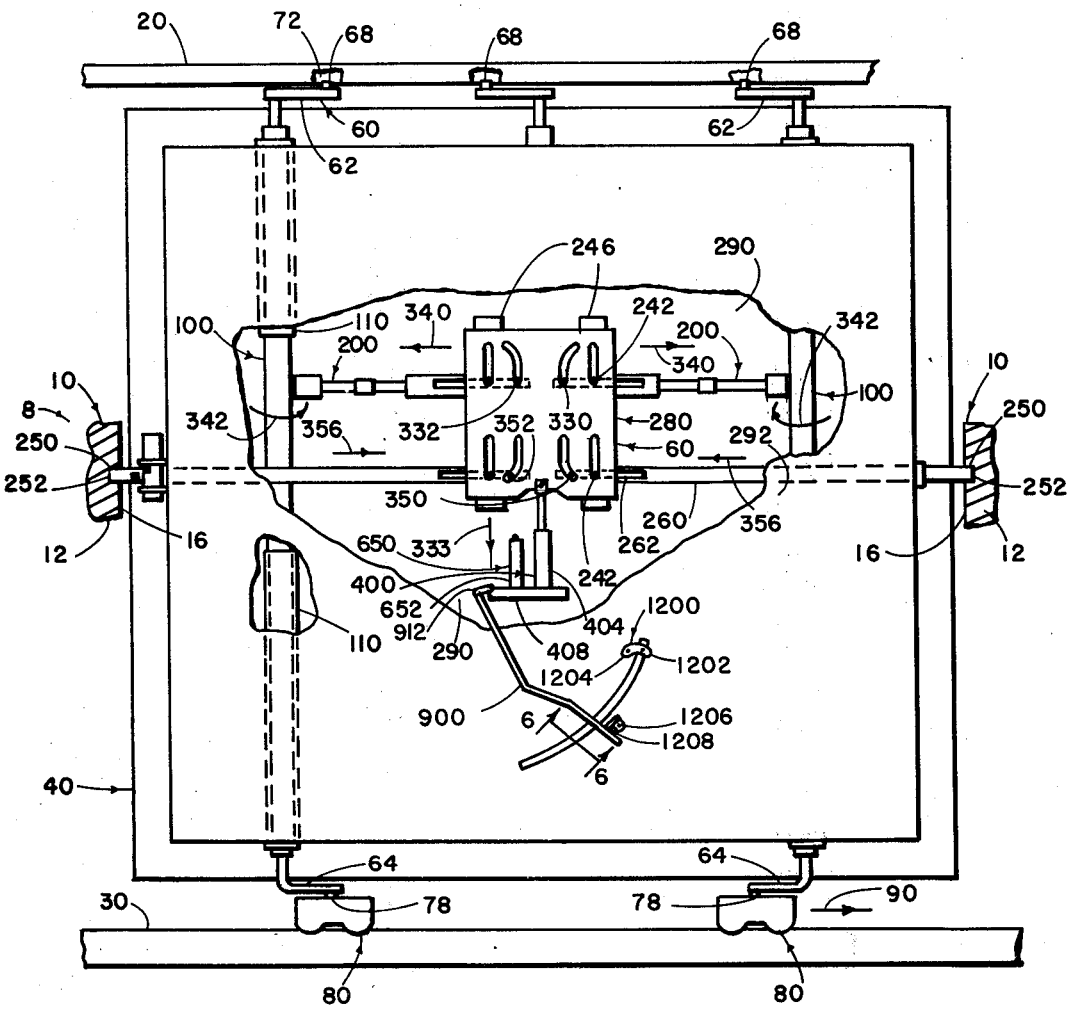
FIG. 1 is a side elevation of a railroad car door of this invention with portions of tracks being diagrammatically shown on which it is mounted, the railroad car itself having only a portion adjacent a door latch shown. A front panel of the door being broken away to show the interior mechanism, and other mechanism being shown in dotted lines. The door is shown in a closed and latched position.

In FIG. 1, a railroad car is generally indicated by the numeral 10, although the only part that is shown is a portion 12 of the door jamb of the railroad car seen at the left of FIG. 1. The railroad car has a door opening 16 in a side wall thereof represented by the door jamb 12, and on that side of the railroad car 10 is an upper guiding and supporting track 20 and a lower guiding and supporting track 30, both of which are horizontal and attached to the railroad car by means not shown in a conventional manner.

A door 40 is mounted in the door opening 16 and is mounted on the tracks 20 and 30 by means later described so as to be adapted to slide longitudinally of the tracks 20 and 30 and of the railroad car so as to cover and uncover the door opening 16.

The door 40 is also adapted to move laterally of itself into and out of the door opening 16 for plugging the door opening and for unplugging the same.

An actuation mechanism for moving the door laterally of itself is generally indicated at 60 in FIG. 1 and comprises upper right and left crank arms 62 and lower right and left crank arms 64. The crank arms extend generally horizontally and the upper crank arms each have an upwardly extending track engager 68 extending upwardly into a slot 72 in the underside of the upper track 20 for making sliding and guiding engagement therewith in a manner permitting the crank arms 62 to swing with respect to the upper track 20.

The lower crank arms 64 are provided on their outer ends with pivot connections 78 which attach their outer ends to roller supporting assemblies 80 respectively, which latter support the door and, in turn, are supported by the lower track 30 and guided thereby for sliding movements therealong in the direction of an arrow 90 for uncovering the door opening 16 by allowing the door to move along the track 30 until it has completely uncovered the door opening 16. The door is then free to also be moved back opposite the door opening 16, all in the usual manner.

Right and left vertically extending crank arm shaft assemblies generally indicated at 100 are provided and are rotatably connected to the door 40 by journaling units 110 which receive the shaft assemblies 100.

The shaft assemblies 100, therefore, extend vertically and the upper and lower ends of the right crank assembly 100 are attached to the right upper and lower crank arms 62 and 64 at the other ends thereof from the ends which are guided by the tracks 20 and 30.

The left shaft assembly 100 is similarly attached at its upper and lower ends to the other ends of respective crank arms 62 and 64 which are opposite from the ends that are guided by the tracks 20 and 30 respectively, as above described.

The crank arms 62 and 64 turn inwardly toward the center of the door at their outer ends when the door is seen in frontal elevation in FIG. 1, so that when the door is in a position laterally spaced away from the railroad car and the door is moving along its track toward the closing position, then when a respective hanger or track following track engager 68 or roller supporting assembly 80 (the latter two elements sometimes being called hangers) strike a stop on a track, the effect of the stoppage of momentum is to cause the door to move laterally inwardly on its crank arms directly into a nested position in the door opening, this being cushioned by a hydraulic cushioning relief valve assembly later described.

The actuation mechanism 60, seen in FIG. 1, for moving the door laterally of itself further has, as parts thereof, right and left crank arm shaft assemblies, control bar assemblies 200 extending at a right angle to and inwardly toward the center of the door from respective right and left crank arm shaft assemblies 100.

Figure 2:
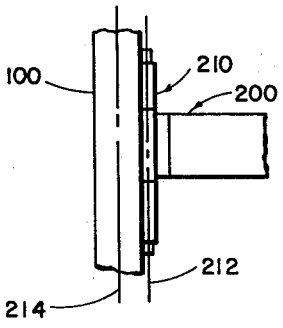
FIG. 2 is a view showing a hinge connection between a portion of a shaft assembly and a shaft assembly rotating bar, the view being taken from an angle such that the hinge assembly is fully visible.
Figure 3:
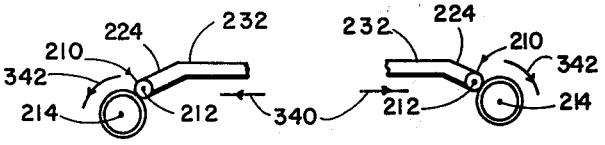
FIG. 3 is a top plan view of the two crank arm carrying shank assemblies on the right and left, as they would be seen looking downwardly from just above the hinge of FIG. 2, as an example.

Those outer ends of the control bar assemblies 200 which are adjacent respective crank arm assemblies 100 are hinged thereto by right and left hinge assemblies 210 one of which is seen in FIG. 2, also seen in FIG. 3. The hinge assemblies 210 make possible hinging about a vertical axis 212 which is offset horizontally to one side of the vertical axis 214 of the respective rotating crank arm assemblies 100.

As best seen in FIG. 3, the control bar assemblies 200 are elongated and their end portions closest to the hinge 210, respectively, incline forwardly from the remainder thereof, which latter is substantially parallel to the tracks 20 and 30 and to the door 40. Such inclined portions are shown at 224 and the parallel portions are shown at 232 in FIG. 3.

Figure 4:
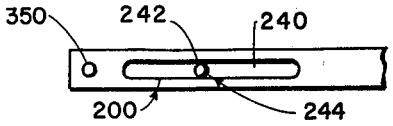
FIG. 4 is a view showing the slotted inner end of a crank arm shaft assembly controlling bar, specifically the one seen in FIG. 1 in the upper right hand corner. This view is from the front and is a detail showing both the pin which is fixed to the slotted assembly and also a pin which is fixed to the framework of the door and which latter is one of four pins which serve as a guide for guiding the upward and downward movements of the program plate.

Referring now to FIG. 4, a slot 240 extends horizontally in the inner end of each of the control bar assemblies 200, the right-hand one being shown in FIG. 4, the slot 240 being for receiving a guide pin 242 of a track assembly 244, which latter is composed of four guide pins 242 of which the pins 242 are secured to mounting brackets 246, which latter are suitably secured to the door 40, as best seen in FIG. 1. There are two upper pins 242 horizontally spaced apart, and two lower pins 242, the two upper pins being for receiving the respective slot 240 of the inner end of respective control bar assemblies 200. The lower pins 242 are for receiving respective right and left latch control bars 260, which latter have slots 262 receiving the pins 242, as seen in FIG. 1.

The latch control bars 260 extend inwardly of the pins 242 along the door and also extend outwardly to the right and left edges of the door respectively where they are attached to latches 250 at the right and left sides of the door, which latter engage in latch notches 252 in the door jamb 12 on each side of the door.

Figure 5:
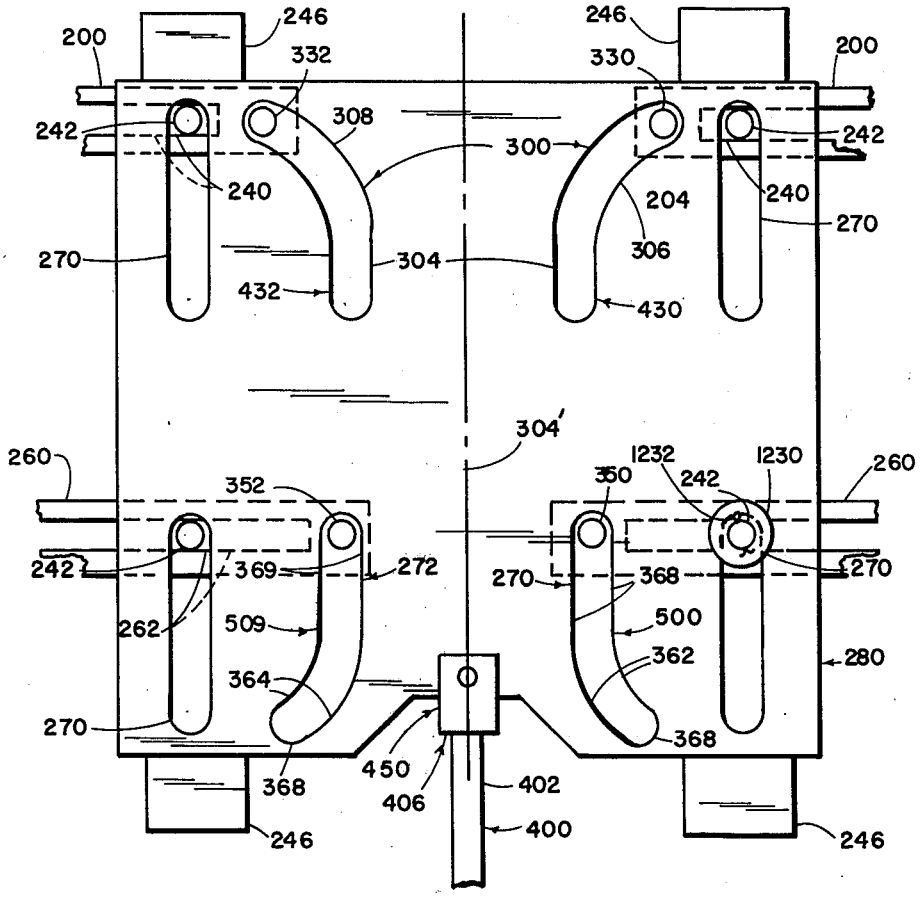
FIG. 5 is a frontal elevation detail of the program plate of FIG. 1 with the program plate shown in a lower position in which the door is unlatched and open, as contrasted to FIG. 1.

As best seen in FIG. 5, the pins 242 are received also in four vertical slots 270 respectively, two of which are above the other two, two of which being right-hand slots and two being left-hand slots, the slots 270 being disposed in a program plate 280, which latter is a vertically disposed flat steel plate arranged parallel to the door 40, the walls of the vertical slots 270 serving to engage the pins 242 so as to guide the program plate 280 during movements upward or downward, as later described.

The bars 200 and 260 are disposed between the program plate 280 and the frame 290 of the door 40, the frame 290 being distinguished from a front cover 292 of the door seen in FIG. 1.

The program plate 280 further has two upper control bar assembly activator slots 300 disposed one on the right and one on the left of a center line 304' which extends through the center of the program plate 280 equidistantly from the right activator slot 300 and the left activator slot 300.

Each activator slot 300 is provided with a vertical lower portion 304 having right and left side wall which are parallel to each other and vertically disposed.

Each activator slot 300 has an upper portion 306 and 308 respectively, which latter, in the case of the right activator slot 300, extend upwardly and continuously from the walls of the lower vertical slot portion 304, respectively, upwardly and gradually curving outwardly away from the center line 304' and toward the right side of the door. The left activator slot 300 has its upper curved portion connecting with the walls of its vertical portion 304 respectively, and gradually curving outwardly and to the left therefrom as the slot 38 extends upwardly.

As thus described, when the program plate 280 moves from the position shown in FIG. 1 downwardly in the direction of an arrow 333 of FIG. 1, this will have the effect of causing the pins 330 and 332 to be moved outwardly for causing the door open from its closed FIG. 1 position, since the pins 330 and 332 are horizontal and cylindrical and attached on their forward sides to the inner ends of the control bar assemblies respectively.

Conversely, when the pins 330 are in the upper ends of the slots 304, as best seen in FIG. 5, they are in the position in which the door is open, and a movement of the program plate 280 upwardly will then cause the pins 330 and 332 to be pulled inwardly from the sides of the door respectively and inwardly toward the center of the door, as seen in FIG. 5, this having the effect of pulling inwardly on the control bar assemblies 200 which has the effect of causing the shaft assemblies 100 to rotate in directions for swinging the crank arms 62 and 64 in directions for closing the door. Arrows shown alongside the control bar assemblies 200 in FIG. 1 correspond to motions thereof that occur when the program plate 280 moves downwardly.

Arrows 340 by the control bar assemblies 200 and indicating outward movement of the control bar assemblies 200 are seen in FIGS. 1 and 2 and correspond to downward movement of the program plate 280 in the direction of the arrow 333 of FIG. 1, such outward movement of the control bar assemblies 200 causing a rotation of the shaft assemblies 100 in the direction of the arrows 342 of FIG. 1 and FIG. 3, which causes the crank arms 62 and 64 to swing so that their outer ends move away from the viewer as the viewer looks at FIG. 1 which causes the door to open by moving outward from its opening 16.

In further sequence downward movement of the program plate 280 in the direction of the arrow 333 of FIG. 1 will cause the latch control bar mounted track follower pins 350 and 352 of FIGS. 1 and 5 which are on the right and left latch control bars 260, respectively, to be moved inward as the program plate 280 moves downward.

This inward movement of the latch control bars 260 in the direction of the arrows 356 of FIG. 1 will cause the latch bars 260 to unlatch the latches 250 at their ends from the notches 252 of the door jamb 12.

This inner movement of the latch control bars 260 is made possible by the curvature of right and left latch control track slots 270 and 272, which latter have lower ends with parallel walls 362 and 364, respectively, for the slots 270 and 272, respectively, which curve inwardly toward the axis 304' as the slot walls 362 and 364 extend upwardly from the lowermost end 368 of the slots 270 and 272. The curved parallel walls 362 and 364 of the right and left slots 270 and 272 join continuously respective upper and straight slot walls 368 and 369, respectively, which latter are further defined as vertically extending straight walls 368 on the right and left side of the upper portion of the right latch bar activation slot 270 and the right and left walls 369 which are vertical and which are on the uppermost portion of the left latch bar actuation slot 272, all as best seen in FIG. 5.

The program plate 280 is moved upwardly and downwardly by a hydraulic cylinder assembly, generally indicated at 400, and having a piston 402 extending upwardly out of a cylinder 404. The piston 402 being connected by a clevis assembly 406, seen in FIG. 5, to the program plate 280 as its under side along the center line 304'.

The cylinder 404 can be seen in FIG. 1 to be mounted on a base assembly 408, which latter is suitably connected to the door frame 290 by welding or other means, whereby the hydraulic cylinder assembly 400 has one of its ends connected to the door, namely, its bottom end.

Referring to FIG. 5, in a broadest sense, right and left door opening and closing track-and-track-follower assemblies are generally indicated at 430 and 432, and each include a track formed by the right and left walls of the respective shaft actuation slots 300 serving as tracks, and the pins 330 and 332 on the control bar assemblies 200, the pins 330 and 332 serving as track followers, each track and its track follower pins 330 or 332 forming first and second interacting elements of the respective track-and-track-follower assemblies 430 and 432. It can be seen that one of these elements, namely, a respective pin 330 or 332 is attached to a respective one of the shaft control bar assemblies 200.

A cylinder connection assembly 450 connects one of the said elements, namely, the program plate with its slots 300 and respective track-walls, to the cylinder assembly 400. Therefore, as described, the cylinder connection assembly 450 comprises the clevis assembly 406 and in another sense comprises any parts of the program plate 280 which connect the clevis assembly 406 with those parts of the program plate 280 which are forming parts of the walls of the slots 330 and 332.

In a broad sense the same relationship applies to the control of the latch control bars 260 in which the latch control actuation pins 350 and 352 form one element of latch control track-and-track-follower assemblies, generally indicated at 500 and 509, in which the pins 350 and 252 form one element, respectively, namely, the track following element and the slots 270 and 272 provide walls which provide the track element which the track follower elements, namely, the pins 350 and 352, follow.

Figures 8, 9:
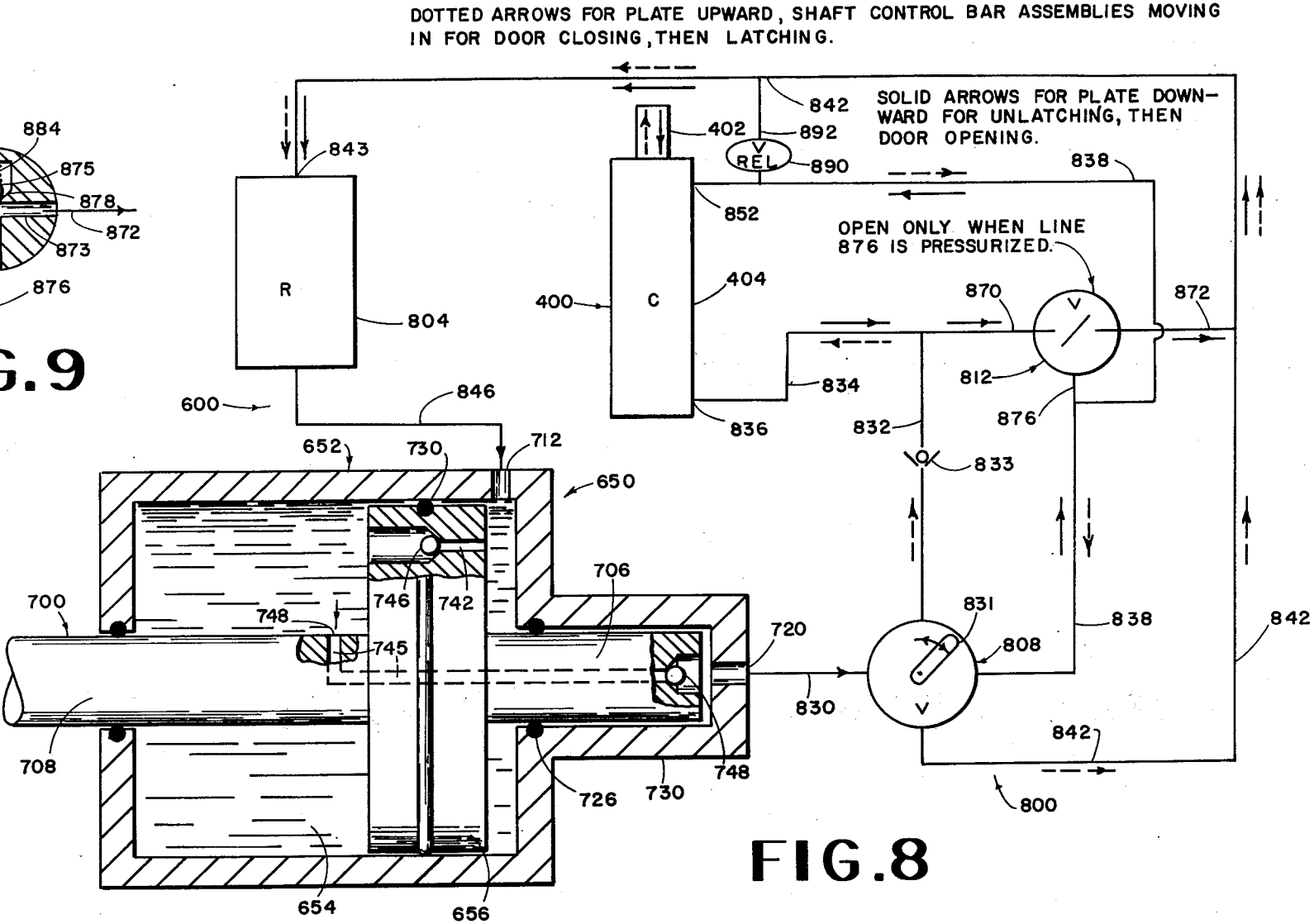
FIG. 8 is a diagrammatic view showing the hydraulic system of this invention with the pump thereof shown in cross section and parts of the piston broken away to show the interior.
FIG. 9 is a view of the door sealing valve, a normally closed pilot-operated check valve shown with its front half removed and the remainder showing partially in section and with parts in position for seating locking so as to prevent flow therethrough.

The hydraulic cylinder assembly 400 of FIG. 1 can also be seen in FIG. 8 where a hydraulic assembly 600 is shown which actuates the cylinder assembly 400.

The hydraulic assembly 600 comprises a pump 650 having an outer housing 652 which is diagrammatically shown in FIG. 1 as being secured to the door frame 290 by the base assembly 408, the housing 652 having a cylindrical main chamber 654 in which a larger portion 656 of a piston, generally indicated at 700, reciprocates, the piston 700 also having forward and rearward smaller portions 706 and 708, which latter extend forwardly and rearwardly from the larger portion 656 of the piston. The housing 652 has an inlet port 712 into the forward end of its main chamber 654 and an outlet 720 extending outwardly of the forward end of a cylindrical forward projecting portion 730 of the housing 652 in which latter the cylindrical forwardly projecting portion 706 of the piston 700 reciprocates with pressure held in by an O-ring 726. The large, large portion of the piston 700 is shown at 656 to be sealed with an O-ring 730 on the inner side of the main chamber 654.

Fluid enters portions of the main chamber 654 which are behind the larger portion 656 of the piston through a passage 742 sealed with a check valve 746 so that flow through the passage 742 is only in a rearward direction and not forwardly.

Fluid from the rearward side of the large portion 656 of the piston flows forwardly through the piston through a passage 745 having an entry 748 on the rear side of the large portion 656 of the piston.

The forward end of the passage 745 lead to a forward check valve 748 permitting fluid to pass out through the forward end of the piston through the forward end of the passageway 745, but the check valve 748 does not permit fluid to enter the main portion of a passage 745.

As thus described, the pump 650 (FIG. 8) can be said to deliver fluid when its piston is moving in the forward direction because the smaller forward portion 706 of the piston will be closed for forcing fluid out through the outlet 720. The pump 650 will also pump when its piston is moving in the rearward direction because at that time the check valve 746 will be held closed and the only way for fluid to escape from the rearward side of the larger piston portion 656 will be through the passageway 745 which will be open because the check valve 748 would be open allowing fluid to pass out through the outlet 720.

In FIG. 8 a hydraulic cylinder extension and retraction control assembly is generally indicated at 800 and includes the pump 650, a fluid reservoir 804, a manually controllable reversing valve 808, and preferably also includes a pressure relief valve 890 for cushioning shock and a door sealing pressure holding pilot operated check valve 812.

In FIG. 8 flow proceeds out of the pump into the line 830 to initiate the closing of a door, as the pump 650 is hand-operated as later described. For door closing the reversing valve 808 has its handle 831 set in a position to adjust it so that flow out from the valve 808 is along the line 832 in which there is a check valve 833 permitting flow only in the direction of the dotted arrow up to a line 834 leading to a lower part 836 of the hydraulic cylinder 404 whereby the hydraulic cylinder is caused to expand so that the plate 280 of FIGS. 1 and 5 can move upward from its lower position shown in FIG. 5 toward its upper position shown in FIG. 1.

As the plate 280 moves upward, first the shaft control bar assemblies 200 will move inward as the pins 330 and 332 are forced upon by the curved lower side of the curved upper portions 306 and 308 of the respective slots 300 as seen in FIG. 5.

This inward movement of the shaft control bar assemblies 200 will cause the shaft assemblies 100 to rotate in a direction opposite to the arrows 342 in FIG. 3 for causing the door to close.

After the door has reached a closed position then the latching actuation slots 270 and 272 will be disposed so that the pins 350 and 352 of FIG. 5 will at that time be disposed at the lower end of the straight upper portions of 368 and 369 of the respective slots 270 and 272 whereby the pins 350 and 352 are about to enter the lower curved portions 362 and 364 of the latching actuation slots 270 and 272.

The last portion of the upward movement of the plate 280, as best seen in FIG. 5, will cause the lower side edges of the curved lower portions 362 and 364 to force against the pins 350 and 352 respectively causing the latch bars 260 to move outward so as to latch.

During this expansion of the cylinder 404, (FIG. 8) the outflow of fluid is from an upper port 852 of the cylinder 404 and dumps through a line 838 leading to the valve 808 which at that time is in a position not only for delivering fluid through the lines 830 and 832 as above described but also for delivering fluid from the line 838 so as to dump into the line 842 for travel back into a port 843 entering the reservoir 804. Simultaneously, fluid from the reservoir 804 flows out through a line 846 into the pump inlet port 712.

In FIG. 8 while fluid is being dumped through the line 838 the amount of pressure from the line 838 into the triggering line 876 for the valve 812 is very weak since 838 is only a fluid dumping line with free flow back to the reservoir. For that reason, the valve 812 is not caused to open. And so, the valve 812 is not open during door closing and latching operation.

In FIG. 8, the flow corresponding to the opening to the door is now explained. First of all, the lever 831 controlling the valve 808 is then set in a different position resulting in outflow from the valve 808 to be not at all in the direction of the line 832 but only along the line 838 in the direction of the solid arrows up to the upper port 852 of the cylinder 404 causing cylinder contraction.

During this cylinder contraction the plate 280 will be caused to move from the "door closed" position of FIG. 1 downwardly in the direction of arrow 333 of FIG. 1 for causing first an unlatching movement of the latch bars 260 inwardly in the direction of the arrows 356 of FIG. 1. After the latch bars 260 have moved inwardly for complete unlatching, the pins 350 and 352 of the latch bars 260 will have reached positions at the ends of the curved lower portions of the latching accuation slots 270 and 272 whereby the pins 350 and 352 then are in the straight upper portions of the slots 270 and 272 FIG. 5 whereby upon further downward movement of the plate, as seen in FIG. 1, no further of the motion of the latch bars 260 occurs and the pins 330 and 332 for controlling the shaft control bar assemblies 200 will have passed through their initial phase of being in the straight lower portions 304 of the slots 300 and will enter the curved upper portions 306 and 308 in which case they will be forced upon by the upper side walls of the curved portions 306 and 308 of the slot 300 for forcing the control bar assemblies 200 outward in the direction of arrows 340 of FIG. 3 for causing rotation of the shaft assemblies 100 in a counterclockwise direction of FIG. 3 which causes the crank arms 62 and 64 to swing in directions for forcing the door open.

In FIG. 8 while the cylinder 404 is contracting for first unlatching and then door opening, oil is being dumped out through the lower port 836 into line 834 and travels through the pilot operated check valve 812, which is at that time open, and into a line 872 to the line 842 for dumping back into the reservoir 804 at its port 843.

The reason this is possible is best understood in FIG. 9 where the pilot operated check valve 812 is shown. In FIG. 9 flow into the valve 812 comes through the line 870 into an inlet passage 871 through a check valve 875 to an outlet passage 873 connected to the line 872 of FIG. 8.

The check valve 875 is disposed in a central cavity 882 having a valve seat 878 in its upper end which the valve 875 seats against for closing flow through the cavity 882 between the passage 871 for entry and the outlet passage 873.

The valve 875 is normally maintained seated by a spring 884 so the valve is a normally closed valve and a plunger 888, attached to the lower side of the ball valve 875, works like a piston in the lower portion of the cavity 882 which later is in communication with the triggering line 876 of FIG. 8 as seen in FIG. 9, also. When the line 876 is pressurized then the valve 875 unseats permitting flow through the pilot operated check valve 812 from the line 870 to the line 872.

Referring to FIG. 8, it will be seen that the triggering line 876 will be pressurized during the pumping that is done while the manually controlled valve 808 is in the unlatching and door opening position so that the pilot operated control valve 876 would then be open, otherwise it is closed.

The purpose of the pressure operated control valve 876 is for causing the door 40 to remain sealed after it has been closed and latched. This sealing is important because the latches 250 themselves are for safety purposes and might be of a fit that is too loose to maintain good sealing. It can be seen that after the door has been closed and then latched, a ceasing of pumping will cause the trigger line 876 to be without pressure whereby the pressure operated control valve 876 will close automatically thereby preventing any flow out from the cylinder 404 to the line 842. For that reason the door will remain sealed until further pumping motion for opening it is initiated in the manner above described involving placing the manual valve 808 in door opening position.

Manual power for the pump 650 is provided, as seen in FIG. 1, by a lever 900 which is adapted to swing in a vertical plane parallel to the door 40 so that its lower terminal end, which can be called its outer end, swings in an arc. The lower end of the lever 900 can be seen in FIG. 6 to have a track follower 908 on it, which is adapted to lock about an arcuate track 904 fixed to the door 40 in a manner such that the lever can be moved along the track 904 but cannot be pulled outwardly away from the track. This is important because the lever 900 is so very long that a very little effort by a vandal, or mistake by an employee, could cause the lever to be pulled outwardly at its bottom, whereby destruction would occur.

The track 904 is disposed in an arc about a horizontal pivot axis 912 of FIG. 1, which is the axis about which the lever 900 pivots.

Figure 7:
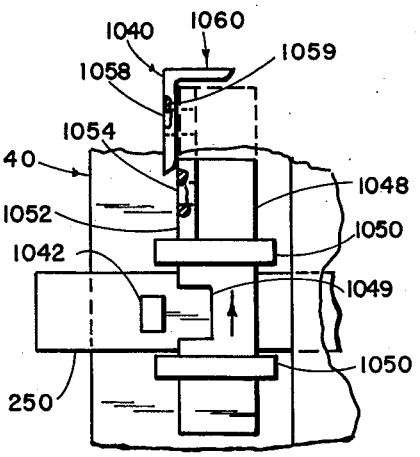
FIG. 7 is a detail of the frontal elevation of a portion of a door and associated parts adjacent one of the latches and showing a latch lock assembly.

Referring now to FIG. 7 a latch-lock assembly, generally indicated at 1040, is there shown, and it comprises a boss 1042 protruding forwardly from and connected to one of the latches 250, for example the left latch 250 is shown. The latch-lock assembly 1040 has a catch 1048, having a notch 1049 therein disposed in a position to receive the boss 1042 at times when the latch 250 is in a completely unlatched position. However, at times when the latch is in a latching position, as shown in FIG. 7, then an operator can move the catch 1048 upwardly until its top is in the dotted line position of FIG. 7, in which latter position a forwardly extending flange 1052 on the catch 1048, will be disposed with an opening 1054 therethrough opposite an opening 1058 in a forwardly to rearwardly extending flange 1059 of a holder, generally indicated at 1060, which latter is suitably fastened to the door 40 on its forward side so that if the shackle of a padlock, not shown, is inserted through the openings 1054 and 1058, the latch 250 cannot be opened and the door will be securely locked because the notch 1049 will not then be opposite the boss 1042 and the catch 1048 will prevent the boss 1042 from moving to the right in FIG. 7.

Another way of locking the door from unauthorized use is seen in FIG. 1, in which a swinging lock arm 1200 is attached to an upper end of the track 904 by a horizontal pivot bolt 1202, whereby the lock arm 1200 can swing downwardly into a position for disposing a lock-shackle opening 1204 in its terminal end opposite a cooperating lock-shackle opening 1206 mounted on a padlock support 1208 fixed to the handle 900 of the pump.

As thus described a padlock can be applied with its shackle extending through the openings 1204 and 1206 to securely fix the lever 900 to the door so that it cannot be operated by unauthorized persons not having a key to a padlock used on the lock support 1208.

Referring to FIG. 5, some means in needed to keep the program plate 280 in place on its guide pins 242. One way is to put a washer on a guide pin 242, as shown at 1230 in the lower right corner of FIG. 5. The washer 1230 is on the forward side of the plate 280 and is of a larger size than the adjacent slot 270 and is kept in place by a suitable means such as a stronger cotter pin 1232 extending through the pin 242 on the forward side of the washer 1230. Such a washer can be used on each of the pins 242, but only one is shown for convenience of illustration, in FIG. 5 and none is shown in FIG. 1.

In FIG. 1, a lever 900 is to be operated by swinging it back and forth in reciprocation since it is connected to the pump 650 of FIG. 8 in such a manner that reciprocation of the lever 900 will cause the piston 700 of the pump to reciprocate. Lever 900 is pivotally mounted for swinging in a vertical plane parallel to the door 40 so as to pivot about a suitable axis such as at 912 in FIG. 1.

Figure 6:
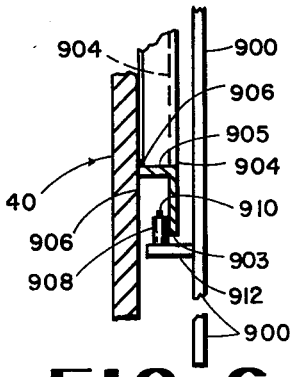
FIG. 6 is a sectional view, taken along the line 6—6 of FIG. 1, showing the connection between a pumping bar and its track assembly.

The lower end of the lever 900 extends across an arcuate track seen in cross section in FIG. 6 where the view is taken along a line 6—6 of FIG. 1, the track being shown at 904 and having a lower edge 903 which is in the arc of a circle about the pivot axis 912 of the lever 900. The lower edge 903 is convex and the track 904 is secured to the door 40 by suitable means such as a support flange 905 welded to the door 40 at 906, as seen in FIG. 6.

The lever 900 has a track follower attached to its rearward side and extending under the lower edge 903 of the track, as regards a portion 912 thereof, which is fixed to the lever 900, and further has a roller 908 mounted on a roller axle 910 which later is preferably extending parallel to a diameter of the circle on which the track 904 lies. As thus described the lever 900 cannot be pulled out away from the door to an extent that would cause the lever to be broken away or to be bent or to be ripped from its connections because the roller 908 engaging the forward side of the track 904 will prevent the lever from moving outwardly from the door to excessive extent.

This construction is important because if the lever can be pulled away from the door then very little effort by a vandal or mistake by an employee could cause damage.

Referring now to FIG. 7, a latch-lock assembly, generally indicated at 1040, is there shown, and it comprises a boss 1042 protruding forwardly from and connected to one of the latches 250, for example the left latch 250 is shown. The latch-lock assembly 1040 has a catch 1048, having a notch 1049 therein disposed in a position to receive the boss 1042 at times when the latch 250 is in a completely unlatched position. However, at times when the latch is in a latching position, as shown in FIG. 7, then an operator can move the catch 1048 upwardly until its top is in the dotted line position of FIG. 7, in which latter position a forwardly extending flange 1052 on the catch 1048, will be disposed with an opening 1054 there-through opposite an opening 1058 in a forwardly to rearwardly extending flange 1059 of a holder, generally indicated at 1060, which latter is suitably fastened to the door 40 on its forward side so that if the shackle of a padlock, not shown is inserted through the openings 1054 and 1058, the latch 250 cannot be opened and the door will be securely locked because the notch 1049 will not then be opposite the boss 1042 and the catch 1048 will prevent the boss 1042 from moving to the right in FIG. 7.

Another way of locking the door from unauthorized use is seen in FIG. 1, in which a swinging lock arm 1200 is attached to an upper end of the track 904 by a horizontal pivot bolt 1202, whereby the lock arm 1200 can swing downwardly into a position for disposing a lock-shackle opening 1204 in its terminal and opposite a cooperating lock-shackle opening 1206 mounted on a padlock support 1208 fixed to the handle 900 of the pump.

As thus described a padlock can be applied with its shackle extending through the openings 1204 and 1206 to securely fix the lever 900 to the door so that it cannot be operated by unauthorized persons not having a key to a padlock used on the lock support 1208.

Referring to FIG. 5, some means is needed to keep the program plate 280 in place on its guide pins 242. One way is to put a washer on a guide pin 242, as shown at 1230 in the lower right corner of FIG. 5. The washer 1230 is on the forward side of the plate 280 and is of a larger size than the adjacent slot 270 and is kept in place by a suitable means such as a stronger cotter pin 1232 extending through the pin 242 on the forward side of the washer 1230. Such a washer can be used on each of the pins 242, but only one is shown for convenience of illustration, in FIG. 5 and none is shown in FIG. 1.

In FIG. 8 a pressure relief valve as shown at 890 and is diposed between the line 842 leading back to the reservoir 804 and any one of the lines that are connected to the outlet 852 which is the outlet fluid would flow out from during an extension of the cylinder 404. For example, the relief valve 890 is disposed in a line 892 disposed between the line 838 and 842.

The relief valve 890 is a spring loaded check valve whereby the flow out from the outlet 852 proceeds not only during above mentioned operations since the pressure is lesser than needed to overcome the spring of the relief valve 890. But when the pressure is in excess of that, the spring of the relief valve 890 is overcome for opening the check valve therein and pressure is relieved through the line 892 back to the reservoir. In general the relief valve 890 can be called a pressure release assembly because other mechanisms can be used other than a relief valve for accomplishing the purpose. For example, a simple orfice, not shown, could also serve the purpose.

The effect of the relief valve 890 is to reduce pressure flowing out from the port 852 in such a manner as to relieve the pressure caused by sudden stoppage of motion of the door in a direction that such a stoppage would cause extension of the cylinder 404. This cushioning is because the relief valve 890 causes a gradual resistance to the rotation of the crank arms 62 and 64 FIG. 1. The crank arms 62 and 64 extend inwardly parallel to the door 40 and to the tracks 20 and 30 and toward a vertical center line of the door 40 at times when the door is closed so that closing motions of the door can cause the crank arms to swing towards the positions just described. Having the crank arms 62 and 64 all turn inwardly as just described at times when the door is closed cooperates with the pressure relief valve 890 because any interruption of motion of the left crank arm 62 and 64 lengthwise tracks 20 and 30 as the door moves lengthwise to the tracks 20 and 30 toward the left will tend to cause the door itself to attempt to move inwardly toward the door opening which would cause the crank arms 62 and 64 to apply a force for rotating the shaft assemblies which is 100 in directions opposite to arrows 342 FIG. 3 whereby the control arm assemblies 200 would move inwardly, as seen in FIG. 5 forcing the plate 280 to move upwardly causing extension of the hydraulic cylinder assembly 400 and flow out through the upper port 852 which then is gradully resisted by the relief valve 890 for cushioning the entire effect of undesired sudden stoppage of the movement of the crank arms 62 and 64 toward the left preparatory to door closing.

I claim:

1. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for reciprocation in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said reciprocations of said program plate, said means mounted on said door for selectively causing extension or retraction of said hydraulic cylinder assembly comprising a hydraulic assembly having a cylinder and having a hydraulic pump and reservoir and having a controllable reversing valve assembly, and means mounted on said pump and said door for manual reciprocation of said pump, said pump having a piston and an inlet and an outlet, said pump being constructed for delivering fluid out of said outlet during movement of said piston in either of two directions, said hydraulic assembly having means connecting said controllable reversing valve to said outlet of said pump and to said reservoir and to said reversing valve in a manner such that the setting of said reversing valve in each of two different positions will cause said pump to extend and retract said hydraulic cylinder assembly respectively, said pump having a housing provided with first and second interconnecting chambers, said pump piston having a first portion closely fitting and reciprocating in said first chamber, said first piston portion reciprocating along an axis, said piston having a second piston portion disposed at one side of said first piston portion and reciprocating therewith and extending along said axis and substantially filling said second housing chamber, said piston having a third portion attached to an opposite side of said first portion from said second piston portion, said third piston portion extending along said axis of reciprocation, said housing having an opening therethrough along said axis of reciprocation and in which said third portion of said piston reciprocates, said pump housing having an inlet extending from the exterior through the wall of said first chamber at an end of said first chamber which is adjacent said second chamber, said pump housing having an outlet at that end of said chamber which is farthest from said first chamber, said first piston portion having a first passage therethrough for hydraulic fluid, said first passage extending from a portion of said first piston portion which is closest to said outlet to that side of said first piston portion which is opposite from said outlet, a check valve in said first passage permitting flow of fluid therethrough only in a direction away from that end of said first piston portion which is adjacent said outlet, said piston having an out-flow second passage therethrough, said out-flow second passage having an inlet in communication with said first pump chamber and disposed on the opposite side of said first piston portion from said pump outlet, said out-flow passage having an out-flow opening on that end of said second piston portion which is adjacent to said pump outlet, said out-flow passage extending through said piston from its said inlet to its said outlet opening, a check valve in said out-flow passage permitting flow through said out-flow passage only in a direction from the inlet of said out-flow passage to the outlet opening of said out-flow passage whereby said check valves and passages function to cause oil to be pumped from said pump housing inlet out through said pump housing outlet as said piston is moved in each of two opposite directions along said axis.

2. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, a latch-lock assembly, said latch-lock assembly comprising a boss on one of said latches, a catch slidably mounted on said door for movement upwardly and downwardly, said catch having a notch therein for receiving said boss at times when said latch is in an unlatched position, said catch being moveable vertically into a position such that its notch is not in a position to receive said boss and so that portions of said catch disposed adjacent said boss at times when said catch is in a locking position are in a position to prevent movement of said boss inwardly toward the center of said door whereby said latch cannot be unlatched while said catch is in said locking position, and cooperative catch-locking means on said door and on said catch for preventing said catch from movement with respect to said door except when said catch locking means is in an unlocked position.

3. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and even having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a hydraulic pump and reservoir and having a controllable reversing valve having two manual settings and having four ports and of which a first port is connected to the outlet of said pump and a door holding valve for holding said door in sealing position, said door holding valve having an inlet and an outlet and having a triggering port and having a spring loaded check valve for one-way flow and permitting flow from said inlet to said outlet only when said triggering port relieves fluid under sufficient pressure, a first line leading from a second port of said controllable valve and receiving fluid at times when said controllable valve is set in a position for door closing and then latching, said first line leading to that one port of said cylinder assembly at which inflow will cause cylinder assembly expansion, a first check valve in said first line preventing flow therethrough toward said controllable valve and permitting flow therethrough from said controllable valve, a second line leading from that other post of said hydraulic cylinder assembly which is expanding, said second line being connected to a third port of said controllable valve and also to said triggering port of said door holding valve, a fluid dumping line leading from the fourth port of said controllable valve to the inlet of said reservoir and dumping fluid back to said reservoir when said controllable valve is in said first setting, a third line leading from said first line to said inlet port of said controllable reversing valve, and a fourth line leading from said outlet port of said controllable reversing valve to said fluid dump line.

4. The railroad car and door assembly of claim 3 having said means mounted on said door for selectively causing extension or retraction of said hydraulic cylinder assembly comprising a hydraulic assembly having a cylinder and having a hydraulic pump and reservoir and having a manually controllable reversing valve assembly, and means mounted on said pump and said door for manual reciprocation of said pump, said pump having a piston and an inlet and an outlet, said pump being constructed for delivering fluid out of said outlet during movement of said piston in either of two directions, said hydraulic assembly having means connecting said manually controllable reversing valve to said outlet of said pump and to said reservoir in a manner such that the setting of said reversing valve in each of two different positions will cause said pump to extend and retract said hydraulic cylinder assembly respectively.

5. The railroad car and door assembly of claim 4 further comprising said hydraulic assembly having a pressure relief valve, said pressure relief valve being a spring loaded check valve, means connecting said pressure relief valve in said hydraulic assembly in a manner such that whenever fluid in lines flowing into or out of said cylinder is at a pressure beyond a desired amount, then fluid pressure will overcome the spring of said spring loaded relief valve whereby fluid flows through said relief valve harmlessly to said reservoir whereby said relief valve can cushion sudden stoppage of movements of said door by providing a gradual resistance to the rotation of said crank arms, said crank arms extending towards a vertical center line of said door when said door is closed whereby said relief valve can cushion sudden stoppage of movements of said door along said tracks in either direction.

6. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a hydraulic pump and reservoir and having a controllable reversing valve and a door holding valve assembly for holding said door in sealing position, said door holding valve assembly having an inlet and an outlet and having a triggering port and having a spring loaded check valve for one-way flow and permitting flow from said inlet to said outlet only when said triggering port is exposed to fluid under sufficient pressure, said hydraulic cylinder assembly having ports at each end, and hydraulic circuit means connecting said cylinder ports and said controllable reversing valve and said pump and said reservoir and said door holding assembly ports so that flow from said pump causes said cylinder to expand and contract when said controllable reversing valve is in each of two positions respectively and so that when said reversing valve is in a first position said pump can deliver flow to said cylinder assembly for causing door closing and when said controllable reversing valve is in a second position said pump can deliver flow to said cylinder for causing door opening.

7. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for reciprocation in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said reciprocations of said program plate, said door having right and left horizontally reciprocating latch bars each having respective right and left latches at their outer ends, means mounting said latch bars reciprocatably on said door for movement of said latching control bars in horizontal directions, latch control pins projecting horizontally from the inner ends of said latch bars respectively, said program plate having latch control slots therein receiving said latch control pins, said door control slots and said latch control slots each having an idling portion in alighnment with said reciprocations of said program plate, said door control slots each having a door moving portion generally gradually inclining in a direction partially transverse to its idling portion, said latch control slots each having a latch bar recovering portion generally inclining in a direction partially transverse to its idling portion and inclining to a different side of the path of reciprocation of said program plate than the said door moving portions of that respective one of said door control slots which indirectly operates said crank arms on a same side of said door whereby movement of said plate in one direction will cause first unlatching and then door opening and movement of said plate in the opposite direction will cause first door closing and then latching.

8. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for movement in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said movements of said program plate, said door having right and left horizontally reciprocating latch bars each having respective right and left latches at their outer ends, means mounting said latch bars reciprocatably on said door for movement of said latching control bars in horizontal directions, latch control pins projecting horizontally from the inner ends of said latch bars respectively, said program plate having latch control slots therein receiving said latch control pins, said door control slots and said latch control slots each having an idling portion in alignment with said movements of said program plate, said door control slots each having a door moving portion generally gradually inclining in a direction partially transverse to its idling portion, said latch control slots each having a latch bar recovering portion generally inclining in a direction partially transverse to its idling portion and inclining to a different side of the path of movement of said program plate than the said door moving portions of that respective one of said door control slots which indirectly operates said crank arms on a same side of said door whereby movement of said plate in one direction will cause first unlatching and then door opening and whereby movement of said plate in the opposite direction will cause first door closing and then latching.

9. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to the other of said elements, said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a cylinder and having a hydraulic pump and reservoir and having a controllable reversing valve assembly, and means mounted on said pump and said door for manual reciprocation of said pump, said pump having a piston and an inlet and an outlet, said pump being constructed for delivering fluid out of said outlet during movement of said piston in either of two directions, said hydraulic assembly having means connecting said controllable reversing valve to said outlet of said pump and to said reservoir and to said controllable reversing valve in a manner such that the setting of said controllable reversing valve in each of two different positions will cause said pump to extend and retract said hydraulic cylinder assembly respectively, said pump having a lever assembly mounted on it, said lever assembly having an elongated hand-operated lever having one end movable in a vertical plane in each of two directions, said lever being on the outer side of said door and said plane being substantially parallel to said door, and lever-supporting track-and-track-follower means mounted on said door and having two interacting elements of which one is a track and one is a track follower moving in said track, means attaching one of said elements of said lever-supporting track-and-track-follower assembly to said door, and means attaching the other element of said track-and-track-follower assembly to the outer end of said lever whereby said track-and-track-follower assembly permits said reciprocating movements of said outer end of said lever but prevents excess movement of said lever in a direction at a right angle to said plane whereby said lever is prevented from being easily damaged.

10. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track-follower assemblies each of which latter include a track and an inter-acting track follower forming respectively first and second interacting elements, one of said elements being attached to a respective one of said shaft control bar assemblies, means mounting the other of said elements respectively on said door.in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said door having right and left horizontally reciprocating latch bars each having respective right and left latches at their outer ends, means mounting said latch bars reciprocatably on said door for movement of said latching control bars in horizontal directions, right and left latching and unlatching track-and-track-follower assemblies each of which latter include a track and an interacting track follower forming first and second interacting latching control elements, one of each of said latching control elements being attached to a respective one of said latch control bars, means connecting the other of the elements respectively of said latch control track-and-track-follower assemblies to said hydraulic cylinder assembly to that said hydraulic cylinder assembly will cause said latching control bars to cause unlatching and latching respectively.

11. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second interacting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a cylinder and having a hydraulic pump and reservior and having a controllable reversing valve assembly, and means mounted on said pump and said door for reciprocation of said pump, said pump having a piston and an inlet and an outlet, said pump being constructed for delivering fluid out of said outlet during movement of said piston in either of two directions, said hydraulic assembly having means connecting said controllable reversing valve to said outlet of said pump and to said reservior in a manner such that the setting of said reversing valve in each of two different positions will cause said pump to extend and retract said hydraulic cylinder assembly respectively, said hydraulic assembly having a pressure relief valve, said pressure relief valve being a spring loaded check valve, means connecting said pressure relief valve in said hydraulic assembly in a manner such that whenever fluid in lines flowing into or out of said cylinder is at a pressure beyond a desired amount, then fluid pressure will overcome the spring of said spring loaded relief valve whereby fluid flows through said relief valve harmlessly to said reservior whereby said relief valve can cushion sudden stoppage of movements of said door by providing a gradual resistance to the rotation of said crank arms, said crank arms extending towards a vertical center line of said door when said door is closed whereby said relief valve can cushion sudden stoppage of movements of said door along said tracks in either direction, said door being provided with a handle lock assembly having a first section attached to said door and a second section attached to said pump handle, said handle lock assembly sections having means thereon for receiving a lock for interconnecting said two sections together in a manner for preventing pumping movements of said handle.

12. A railroad car and door assembly having upper and lower guiding and supporting horizontal door tracks, a door jamb between said tracks, a sliding door between said door tracks and generally vertically extending and horizontally movable for opening said movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second interacting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for reciprocation in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said reciprocations of said program plate, said means movably attaching said program plate to said door comprising a plurality of guide pins, said program plate having a plurality of vertically elongated slots slidably receiving said guide pins for the vertical sliding of said plate on said guide pins, and means attached to the terminal ends of said guide pins and retaining said plate on said guide pins.

13. A railroad car and door assembly of claim 12 having said shaft control assemblies each having a horizontal slot therein slidably disposed on a respective one of said guide pins for the horizontal sliding of said control bar assemblies respectively on said guide pins whereby the same guide pins which guide movements of said plate also guide horizontal sliding movements of said control bar assemblies.

14. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm havng an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second interacting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a cylinder and having a hydraulic pump and reservoir and having a controllable reversing valve assembly, and means mounted on said pump and said door for manual reciprocation of said pump, said hydraulic assembly having means connecting said controllable reversing valve to said outlet of said pump and to said reservior in a manner such that the setting of said reversing valve in each of two different positions will cause said pump to extend and retract said hydraulic cylinder assembly respectively, said hydraulic assembly having a pressure relief valve, said pressure relief valve being a spring loaded check valve, means connecting said pressure relief valve in said hydraulic assembly in a manner such that whenever fluid in lines flowing into or out of said cylinder is at a pressure beyond a desired amount, then fluid pressure will overcome the spring of said spring loaded relief valve whereby fluid flows through said relief valve harmlessly to said reservior whereby said relief valve can cushion sudden stoppage of movements of said door by providing a gradual resistance to the rotation of said crank arms, said crank arms extending towards a vertical center line of said door when said door is closed whereby said relief valve can cushion sudden stoppage of movements of said door along said tracks in either direction, one of said elements of said lever-supporting track-and-follower assembly which is attached to said door is specifically a track having an edge spaced from said door and dispersed between said lever and said door, the other element of said track-and-track-follower assembly being a track follower comprising a first portion disposed between said track and said door, said track follower having a second portion interconnecting said first track follower portion and said lever exteriorly of said track whereby any force urging said lever away from said door to an excessive extent will be resisted by engagement of said first portion of said track follower with the door side of said track.

15. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a cylinder and having a hydraulic pump and reservoir and having a manually controllable reversing valve assembly, and means mounted on said pump and said door for manual reciprocation of said pump, said pump having a piston and an inlet and an outlet, said pump being constructed for delivering fluid out of said outlet during movement of said piston in either of two directions, said hydraulic assembly having means connecting said manually controllable reversing valve to said outlet of said pump and to said reservoir in a manner such that the setting of said reversing valve in each of two different positions will cause said pump to extend and retract said hydraulic cylinder assembly respectively, said hydraulic assembly having a pressure relief valve, said pressure relief valve being a spring loaded check valve, means connecting said pressure relief valve in said hydraulic assembly in a manner such that whenever fluid in lines flowing into or out of said cylinder is at a pressure beyond a desired amount, then fluid pressure will overcome the spring of said spring loaded relief valve whereby fluid flows through said relief valve harmlessly to said reservoir whereby said relief valve can cushion sudden stoppage of movements of said door by providing a gradual resistance to the rotation of said crank arms, said crank arms extending towards a vertical center line of said door when said door is closed whereby said relief valve can cushion sudden stoppage of movements of said door along said tracks in either direction, one of said elements of said lever-supporting track-and-follower assembly which is attached to said door is specifically a track having an edge spaced from said door and disposed between said lever and said door, the other element of said track-and-track-follower assembly being a track follower comprising a first portion disposed between said track and said door, said track follower having a second portion interconnecting said first track follower portion and said lever exteriorly of said track whereby any force urging said lever away from said door to an excessive extent will be resisted by engagement of said first portion of said track follower with the door side of said track, said second portion of said track follower having two sections, the first of said latter sections being a roller and a second of said latter sections being an axle for said roller mounting said roller in a manner for rolling freely against the door side of said track at times when said lever is reciprocated.

16. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounted on said door for selectively causing extension or retraction of said hydraulic cylinder assembly comprising a hydraulic assembly having a hydraulic pump and reservoir and having a manually controllable reversing valve and a door holding valve assembly for holding said door in sealing position, said door holding valve assembly having an inlet and an outlet and having a triggering port and having a spring loaded check valve for one-way flow and permitting flow from said inlet to said outlet only when said triggering port is exposed to fluid under sufficient pressure, said hydraulic cylinder assembly having ports at each end, and hydraulic circuit means connecting said cylinder ports and said manually controllable reversing valve and said pump and said reservoir and said door holding assembly ports so that flow from said pump causes said cylinder to expand and contract when said reversing valve is in each of two positions respectively and so that when reversing valve is in first position said pump can deliver flow to said cylinder assembly for door closing and when reversing valve is in a second position said pump can deliver flow to said cylinder.

17. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for reciprocation in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said reciprocations of said program plate, said door having right and left horizontally reciprocating latch bars each having respective right and left latches at their outer ends, means mounting said latch bars reciprocatably on said door for movement of said latching control bars in horizontal directions, latch control pins projecting horizontally from the inner ends of said latch bars respectively, said program plate having latch control slots therein receiving said latch control pins, said door control slots and said latch control slots each having an idling portion in alignment with said reciprocations of said program plate, said door control slots each having a door moving portion generally gradually inclining in a direction partially transverse to its idling portion, said latch control slots each having a latch bar recovering portion generally inclining in a direction partially transverse to its idling portion and inclining to a different side of the path of reciprocation of said program plate than the said door moving portions of that respective one of said door control slots which indirectly operates said crank arms on a same side of said door whereby movement of said plate in one direction will cause first unlatching and then door opening and movement of said plate in the opposite direction will cause first door closing and then latching.

18. A railroad car and door assembly having upper and lower guiding and supporting horizontal door tracks, a door jamb between said tracks, a sliding door between said door tracks and generally vertically extending and horizontally movable for opening and movable along said door tracks, an actuation mechanism for opening and closing said door comprising: upper right and left crank arms and lower right and left crank arms, said crank arms being generally horizontally extending and each having a track engaging means at one end making sliding and guiding and pivoting and door supporting engagement with a respective one of said door tracks, right and left vertically extending crank arm shaft assemblies, means rotatably mounting said crank arm shaft assemblies on said door, each crank arm having an inner end attached to a respective end of a respective crank arm shaft assembly, each crank arm having an outer end, means rotatably and slidably connecting the outer end of each of said crank arms to a respective one of said tracks whereby said door is supported through said crank arms and said crank arm shaft assemblies, right and left crank arm shaft assembly control bar assemblies extending transversely and inwardly of said door from respective crank arm shaft assemblies respectively, outer ends of said shaft assembly control bar assemblies being hingedly connected to said right and left control shaft assemblies respectively in a manner whereby horizontal motions of said control bar assemblies in each of two opposite directions will cause said shaft assemblies to rotate in each of two opposite directions, right and left door opening and closing track-and-track follower assemblies each of which latter include a track and an inter-acting track follower forming respectively first and second inter-acting elements, one of said elements being attached to a respective one of said shaft control bar assemblies, means mounting the other of said elements respectively on said door in a movable manner for movement in each of two directions, a hydraulic cylinder assembly having one end attached to said door, means connecting the other end of said hydraulic cylinder assembly to said means attaching the other of said elements movably to said door and said track-and-track-follower assemblies being so shaped that as the length of said hydraulic cylinder assembly is changed said shaft control bar assemblies will be caused to move in each of two opposite directions for causing said crank arm control shafts to swing said crank arms in directions for opening and closing said door respectively, and means mounted on said door for selectively causing extension and retraction of said hydraulic cylinder assembly, said means mounting said other element of each said track and track-and-track-follower assemblies movably on said door comprising a program plate and means movably attaching said program plate to said door for movement in first and second opposite directions, said program plate having door position control slots therein, the walls of said door position control slots serving as said tracks, the other element of each of said track-and-track-follower assemblies being a pin disposed in a respective one of said door position control slots and guided by the walls of said door position control slots respectively as said program plate moves with respect to said door, said program plate defining said means for attaching said others of said elements movably to said door, said means connecting the other end of said hydraulic cylinder serving to attach said hydraulic cylinder other end to said program plate in a manner such that changes in the length of said hydraulic cylinder causes said movements of said program plate, said door having right and left horizontally reciprocating latch bars each having respective right and left latches at their outer ends, means mounting said latch bars reciprocatably on said door for movement of said latching control bars in horizontal directions, latch control pins projecting horizontally from the inner ends of said latch bars respectively, said program plate having latch control slots therein receiving said latch control pins, said door control slots and said latch control slots each having an idling portion in alignment with said movements of said program plate, said door control slots each having a door moving portion generally gradually inclining in a direction partially transverse to its idling portion, said latch control slots each having a latch bar recovering portion generally inclining in a direction partially transverse to its idling portion and inclining to a different side of the path of movement of said program plate than the said door moving portions of that respective one of said door control slots which indirectly operates said crank arms on a same side of said door whereby movement of said plate in one direction will cause first unlatching and then door opening and movement of said plate in the opposite direction will cause first door closing and then latching, said means mounted on said door for selectively causing extension or retraction of said hydraulic cylinder assembly comprising a hydraulic assembly having a cylinder and having a hydraulic pump and reservoir and having a controllable reversing valve assembly, and means mounted on said pump and said door for reciprocation of said pump, said pump having a piston and an inlet and an outlet, said hydraulic assembly having means connecting said controllable reversing valve to said outlet of said pump and to said reservoir and to said reversing valve in a manner such that the setting of said reversing valve in each of two different positions will cause said pump to extend and retract said hydraulic cylinder assembly respectively.

* * * * *